US005121681A

United States Patent [19]

Chang

[11] Patent Number: 5,121,681

[45] Date of Patent: Jun. 16, 1992

[54] EXTENDIBLE BOOK SHELF

[76] Inventor: Wen C. Chang, No. 78-6, Yungho Rd., Taya Hsiang, Taichung Hsien, Taiwan

[21] Appl. No.: 728,259

[22] Filed: Jul. 11, 1991

[51] Int. Cl.[5] ..... A47B 85/00

[52] U.S. Cl. ..... 108/25; 211/42; 108/65

[58] Field of Search ..... 108/65, 60, 61, 143, 108/137, 102, 25; 211/42, 43, 184

[56] References Cited

U.S. PATENT DOCUMENTS

| | | | |
|---|---|---|---|
| 799,371 | 9/1905 | Eustis | 211/43 X |
| 1,660,823 | 2/1928 | Thometz | 211/43 X |
| 1,682,060 | 8/1928 | Banks | 211/43 |
| 2,545,844 | 3/1951 | Cougias | 211/43 |
| 3,295,694 | 1/1967 | Nejezchleb et al. | 211/42 X |
| 3,389,805 | 6/1968 | Yeomans | 211/43 |
| 3,760,744 | 9/1973 | Cruckshank | 108/102 X |
| 4,066,168 | 1/1978 | O'Toole et al. | 211/42 X |
| 4,410,093 | 10/1983 | Chiariello et al. | 211/184 X |
| 4,807,538 | 2/1989 | Hoffman | 108/25 |

*Primary Examiner*—José V. Chen

*Attorney, Agent, or Firm*—Morton J. Rosenberg; David I. Klein

[57] ABSTRACT

A book shelf including a base having a channel formed in a bottom for slidably receiving a slide, a number of holes formed along each of two side edges of each of the base and the slide, two stays each including a pair of legs coupled together at an arm, the legs of the stays being engageable in the holes of the base and the slide so that objects which are disposed on the book shelf can be supported between the stays.

4 Claims, 3 Drawing Sheets

EXTENDIBLE BOOK SHELF

BACKGROUND OF THE INVENTION

1. Field of the Invention

The present invention relates to a book shelf, and more particularly to a extendible book shelf.

2. Description of the Prior Art

Typical book shelves have fixed configuration and are generally unextendible.

The present invention has arisen to mitigate and/or obviate the afore-described disadvantages of the conventional book shelves.

SUMMARY OF THE INVENTION

The primary objective of the present invention is to provide a book shelf which is extendible.

In accordance with one aspect of the invention, there is provided a book shelf including a base having a channel formed in a bottom for slidably receiving a slide, a number of holes formed along each of two side edges of each of the base and the slide, two stays each including a pair of legs coupled together at an arm, the legs of the stays being engageable in the holes of the base and the slide so that objects which are disposed on the book shelf can be supported between the stays.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
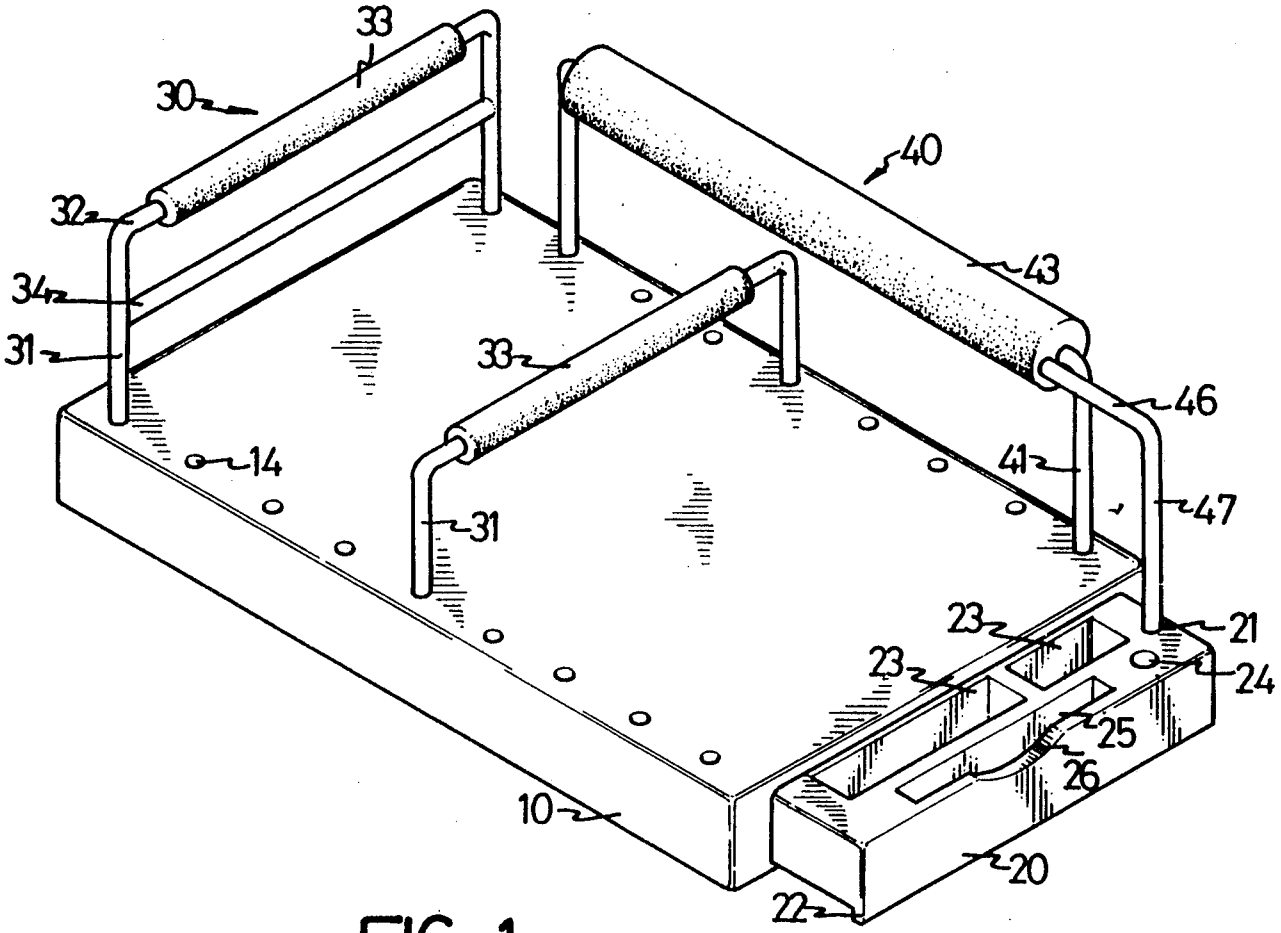
FIG. 1 is a perspective view of a book shelf in accordance with the present invention.
Figure 2:
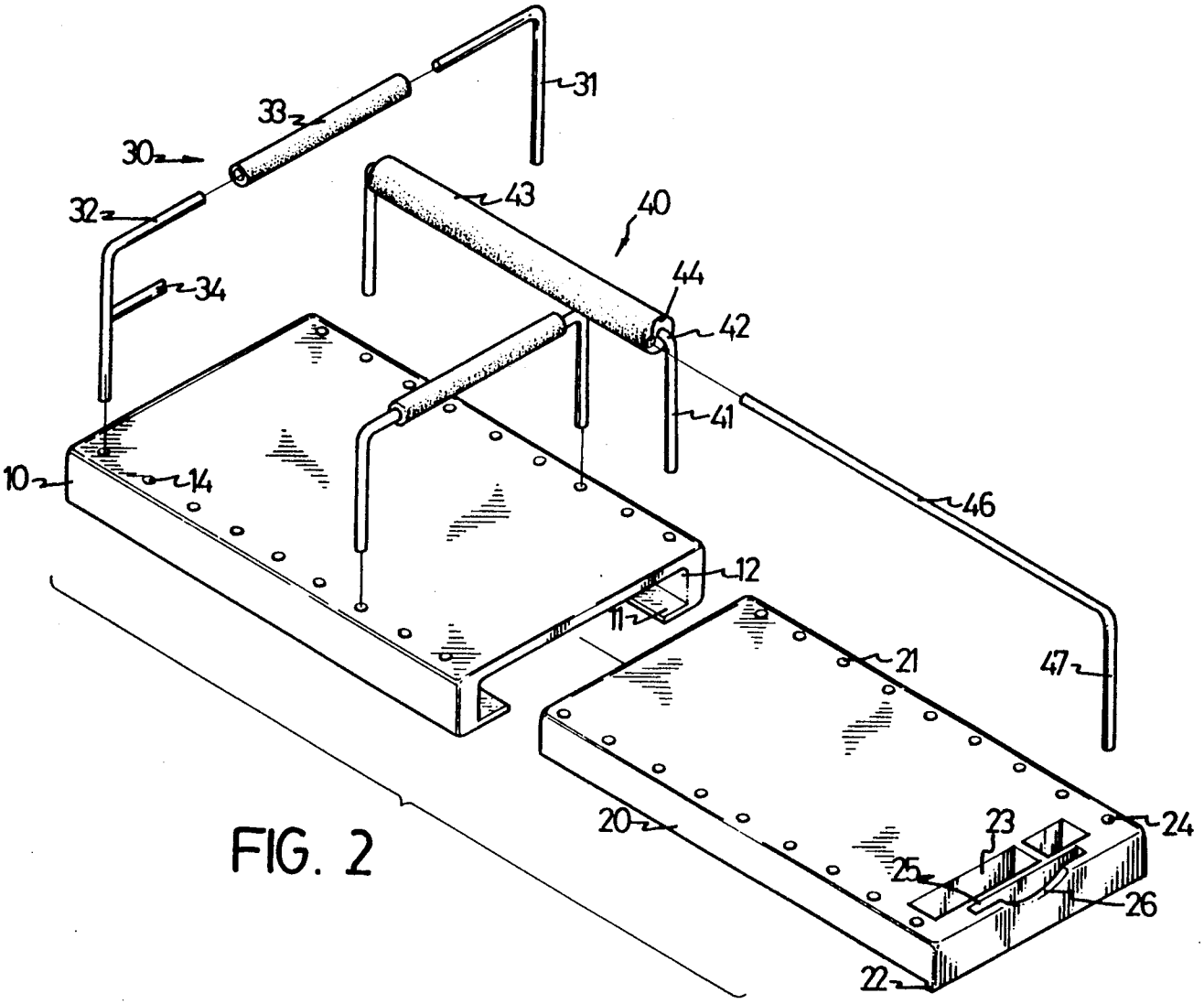
FIG. 2 is an exploded view of the book shelf.

Referring to the drawings and initially to FIGS. 1 and 2, a book shelf in accordance with the present invention comprises generally a base 10, a slide 20 and at least two stays 30 engaged on the base 10 or the slide 20 so that books or the like can be disposed and supported between the stays 30.

The base 10 includes a pair of flanges 11 formed longitudinally in the bottom thereof so that a channel 12 is formed longitudinally in the bottom of the base 10 for receiving the slide 20; and a plurality of holes 14 formed along two opposite side edges thereof. The slide 20 also has a plurality of holes 21 formed along two side edges thereof. A rib 22 is laterally formed on the bottom of a first end of the slide 20 so that the slide 20 can be easily caused to move relative to the base 10. The first end of the slide 20 has two dents 23 formed therein for receiving objects such as thumb tacks, rubber, staples, paper clips or pins, etc., and has a cavity 24 and a recess 25 formed therein. A pen can either be engaged vertically in the cavity 24 or can be disposed within the recess 25 A depression 26 is formed beside the recess 25 so that the pen disposed in the recess 25 can be easily obtained.

Each of the stays 30 is substantially U-shaped including a pair of legs 31 coupled together by an arm 32 on which a cushioning sleeve 33 is disposed thereon. A pole 34 is preferably formed between the legs 31 in parallel to the arm 32 for reinforcement purposes. The lower ends of the legs 31 are engageable in the holes 14, 21 of the base 10 and the slide 20 so that books or the like can be stably held between the stays 30. Optionally, another stay 40 is provided and engageable with the holes 14, 21 formed on one of the side edges of the base 10 and the slide 20. The stay 40 is also substantially U-shaped including a pair of legs 41 coupled together by an arm 42 on which a cushioning sleeve 43 is disposed thereon. The sleeve 43 has an aperture 44 longitudinally formed therein. The stay 40 further comprises an L-shaped extension which includes a first limb 46 slidably engageable in the aperture 44 of the sleeve 43, and a second limb 47 engageable in the holes 21 of the slide 20.

Figure 3:
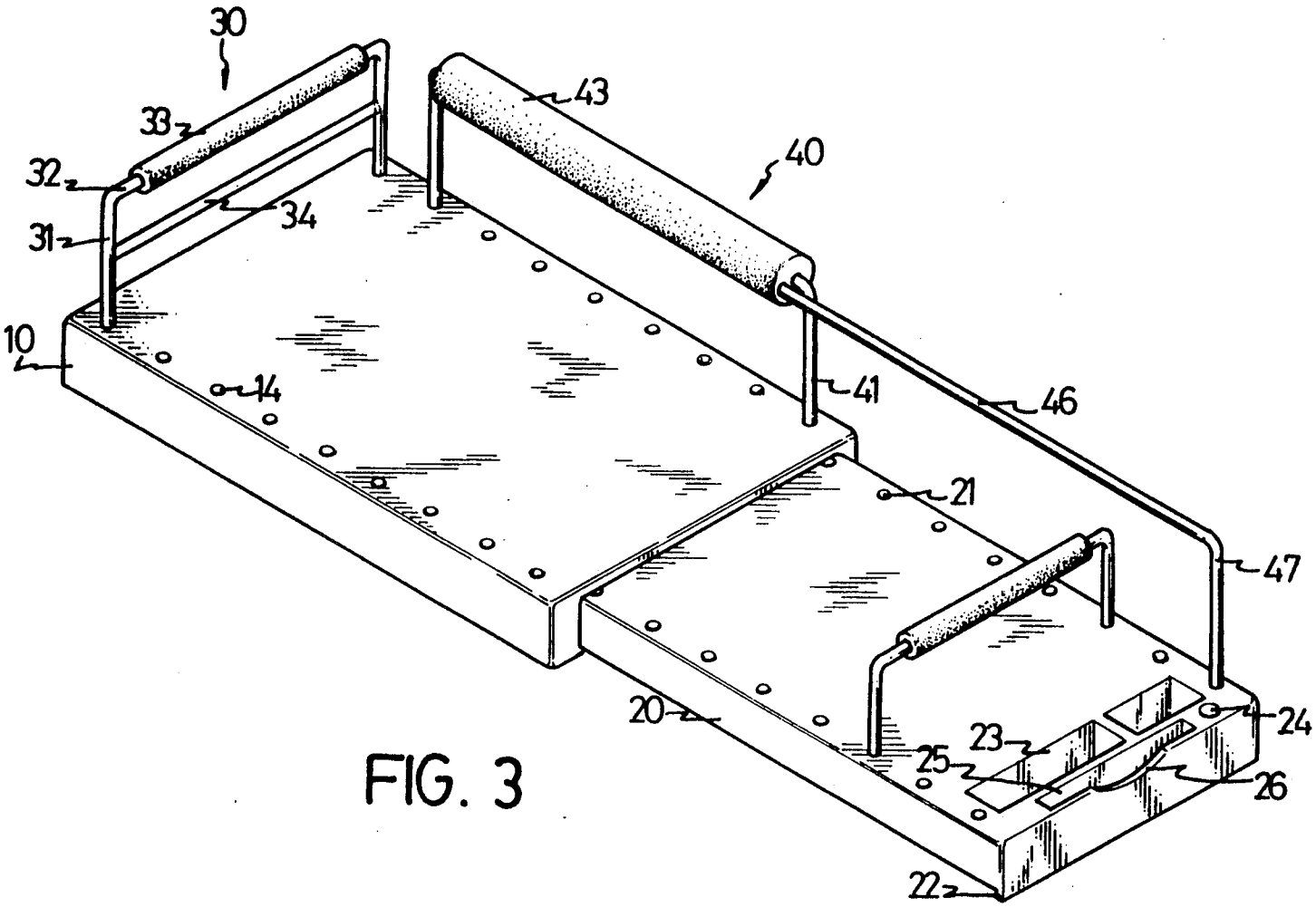
FIG. 3 is a perspective view of the book shelf which is in an extended position.

Referring next to FIG. 3, when the slide 20 is moved outward of the channel 12 of the base 10 and when the second limb 47 of the stay 40 is engaged in the hole 21 of the slide 20, the book shelf in accordance with the present invention can be easily extended. The stay 40 acts as a back stay for the books which are disposed on the book shelf. The sleeve 33 is preferably made of spongy or plastic materials such that the books are prevented from directly contacting the stays 30 which are generally made of metal materials. The stay 40 is preferably made of plastic materials.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A book shelf comprising a longitudinally extending base member having a channel formed in a bottom section thereof; said base member having opposing transverse edge sections extending in said longitudinal direction, each of said edge sections having a plurality of longitudinally aligned first holes formed therethrough; a slide member slidably received within said channel of said base member; said slide member having opposing transverse edge sections extending in said longitudinal direction, each of said slide edge sections having a plurality of longitudinally aligned second holes formed therethrough, said second holes of said slide member being vertically alignable with said first holes of said base member; at least two first stay members, each of said first stay members being substantially U-shaped including a pair of vertically directed legs coupled together by an arm member, said legs of said first stay members being insertable through said first holes and said second holes of said base member and said slide member for coupling said base and slide members each to the other whereby objects which are disposed on said book shelf can be supported between said first stay members; and, a second stay member being substantially U-shaped in contour defining a second stay member arm secured on opposing ends thereof to a pair of leg members insertable within said first and second holes, said second stay member having a sleeve mounted on said arm member, said sleeve having an aperture formed therethrough for slideable insert of one limb of an L-shaped extension member, said other limb of said extension member insertable in said first and second holes of said base and slide members.

2. A book shelf according to claim 1, wherein each of said first stay members includes a cushioning sleeve disposed on each of said arm members so that said objects are prevented from directly contacting said first stay members.

3. A book shelf according to claim 1, wherein each of said first stay members includes a pole integrally formed between said legs for reinforcing said first stay members.

4. A book shelf according to claim 1, wherein a first recess and at least a second recess are formed in said slide member for accommodating pens and small objects respectively.

* * * * *